United States Patent [19]

Daniel et al.

[11] Patent Number: 4,495,919

[45] Date of Patent: Jan. 29, 1985

[54] CONTROL SYSTEM FOR AIR/FUEL RATIO ADJUSTMENT SYSTEM

[75] Inventors: Neville H. Daniel, Sutton Coldfield; Hugh M. Duncan, Moseley, both of England

[73] Assignee: Austin Rover Group Limited, England

[21] Appl. No.: 634,585

[22] Filed: Jul. 26, 1984

[51] Int. Cl.[3] ..... F02B 3/00

[52] U.S. Cl. ..... 123/440; 123/489

[58] Field of Search ..... 123/486, 440, 489; 73/23

[56] References Cited

U.S. PATENT DOCUMENTS 4,224,913 9/1980 Barnard ..... 123/440

4,309,971 1/1982 Chiesa ..... 123/486

*Primary Examiner*—Ronald B. Cox

*Attorney, Agent, or Firm*—Thomas J. Greer, Jr.

[57] ABSTRACT

The invention is concerned with a control system for an air/fuel ratio measurement and adjustment system for an internal combustion engine. In order to restrict operation of the air/fuel ratio measurement and adjustment system to occasions when adjustment is likely to be necessary, it is desirable to operate the system at approximately daily intervals. The control system incorporates an ambient temperature sensor and an engine coolant temperature sensor and is arranged to operate the measurement and adjustment system when the engine is started if the engine coolant temperature does not exceed the ambient temperature by more than a predetermined amount.

6 Claims, 2 Drawing Figures

CONTROL SYSTEM FOR AIR/FUEL RATIO ADJUSTMENT SYSTEM

Figure 1:
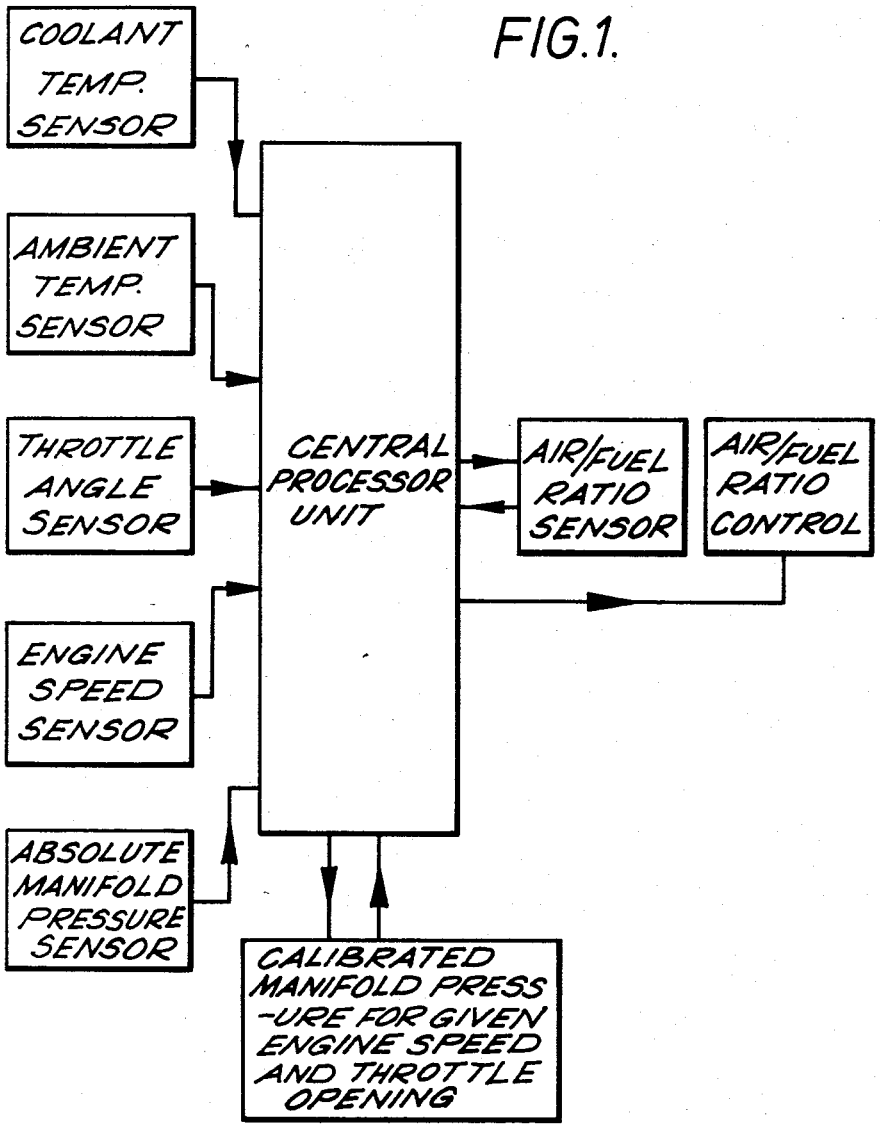

The invention relates to control systems for air/fuel ratio adjustment systems for internal combustion engines. It has already been proposed, for example in our co-pending UK Patent Application No. 8216444, to measure the air/fuel ratio at which an internal combustion engine is operating by detecting and measuring combustible or combustion-supporting constituents in the exhaust gas. This measure is then used to effect an adjustment to bring the air/fuel ratio to a desired level. In this process of detecting combustion-supporting constituents, an auxiliary fuel such as butane is used. It is desired that the consumption of the auxiliary fuel should be kept to a minimum to avoid continuous replacement of small auxiliary fuel canisters and for that reason it is desired to control the operation of the air/fuel ratio measurement and adjustment system in such a way that the measurement system is operated only when there is a reasonable likelihood that adjustment will be required. In principle, it is desirable to operate the measuring and adjustment system once per day when the internal combustion engine is in use and also to operate the measurement and adjusting system when a vehicle in which the engine is installed undergoes a substantial change in altitude. A change in ambient pressure associated with a change in altitude can result in a change in air/fuel ratio and thus a requirement for adjustment.

An object of the present invention is to provide a control system for an air/fuel ratio measurement and adjustment system for an internal combustion engine which operates at approximately daily intervals.

Our co-pending patent application no. filed on the same date as the present application is concerned with corresponding operation in response to changes in altitude.

According to the invention there is provided a control system for an air/fuel ratio measurement and adjustment system for an internal combustion engine, the control system comprising: an ambient temperature sensor, an engine coolant temperature sensor and means for initiating measurement of the air/fuel ratio in response to the engine coolant temperature not exceeding ambient temperature by more than a predetermined amount. During normal use of a vehicle several occasions during a day, the coolant temperature drops slowly towards ambient temperature while the engine is not operating but will take several hours to approach within say 5° of ambient temperature. Thus if a vehicle is used several times during a day, the coolant temperature does not approach close to ambient temperature during the day. In contrast, when a vehicle is left overnight the coolant temperature drops substantially to ambient temperature and as ambient temperature rises in the morning the coolant temperature may be below ambient temperature. Thus by effecting an air/fuel ratio measurement only when coolant temperature approaches or is less than ambient temperature, the measurements are effected approximately once per day.

Preferably the control system also comprises means for measuring the extent of engine inlet throttle opening, engine speed and absolute inlet manifold pressure, means for deriving from stored information an expected inlet manifold pressure to correspond to the measured throttle opening and engine speed, means for deriving and storing the ratio between the expected and actual manifold pressures, means for comparing a subsequently derived ratio between expected and actual manifold pressures with a previously determined such ratio and means for initiating measurement of the air/fuel ratio in response to a predetermined extent of change in said pressure ratio. In this way, a pressure sensor for inlet manifold pressure, which is also needed for other purposes, serves as the basis for providing a measure of ambient pressure and thus avoids the need for an independent ambient pressure sensor.

Preferably the control system also incorporates means for detecting engine operating parameters capable of indicating vehicle operation in a normal cruising mode and means for preventing initiation of air/fuel ratio measurement except when the vehicle is operating in a normal cruising mode.

Figure 2:
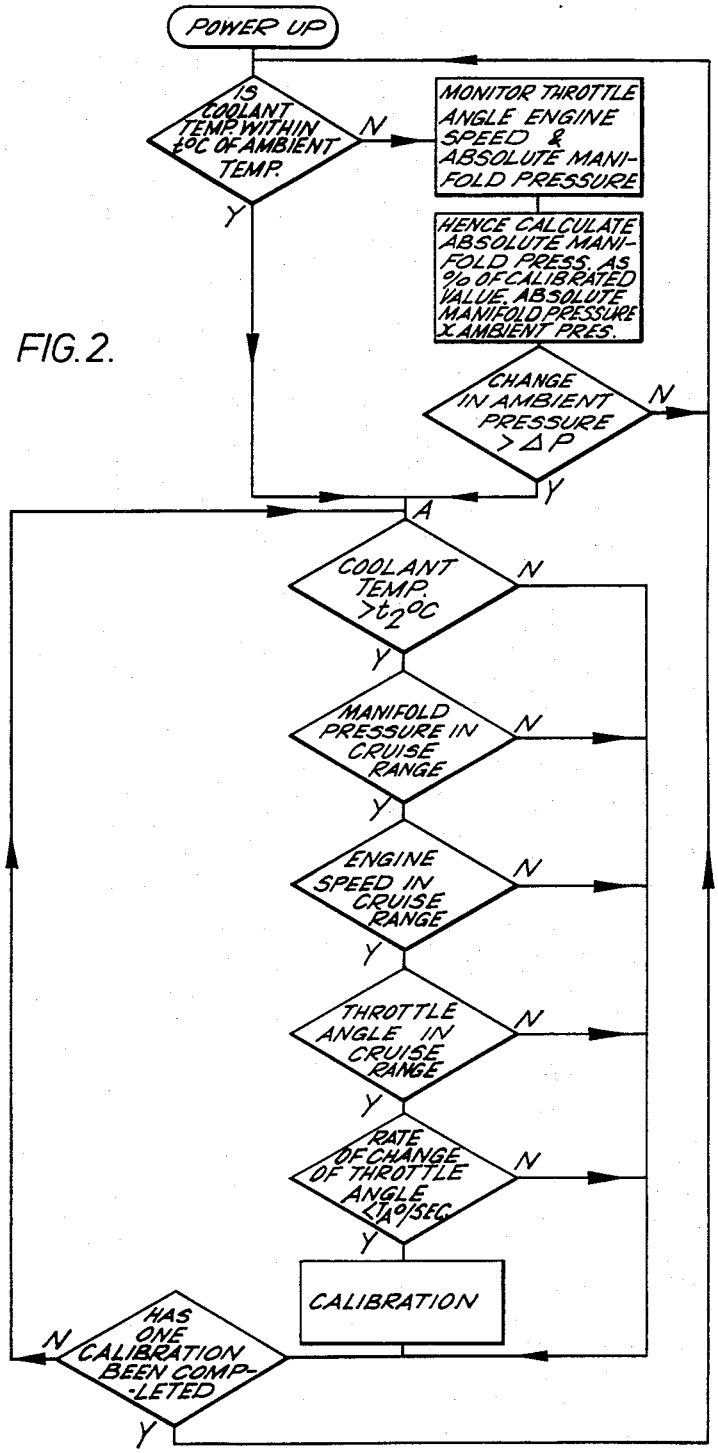

An embodiment of the invention will be described with reference to the accompanying drawings in which:

FIG. 1 is a block diagram showing the fundamental units employed in the present invention including a central processor unit; and FIG. 2 is a flow chart indicating the nature of the operations carried out in the central processor unit.

As shown in FIG. 1, a central processor unit constituted by a digital micro-processor is connected to receive signals from the following sources:

(a) An engine coolant temperature sensor. This may be the same sensor as is used to give the vehicle driver an indication of coolant temperature although an accurate sensor capable of measuring changes of the order of 2° C. is required.

(b) An ambient temperature sensor. This requires similar accuracy to the coolant temperature sensor and should be disposed on the vehicle away from sources of local heat such as exhaust systems, brakes and the engine itself but also in a position where extensive solar heating above normal ambient temperature will not occur.

(c) A throttle angle sensor. This unit is required to measure the degree of throttle opening and in the case of a sliding throttle would not measure angle as such.

(d) An engine speed sensor.

(e) An absolute inlet manifold pressure sensor. In an accurately controlled fuel metering system for an internal combustion engine, the fuel supply rate is controlled directly in accordance with absolute manifold pressure so such a pressure sensor is a normal part of the fuel system.

The central processor unit also has access to stored data relating expected manifold pressure to engine speed and throttle opening when operating at sea level at normal atmospheric pressure. This data may for example be established by calibration of a test engine. Recalibration is required only after substantial altitude changes of say 300 meters so only a limited amount of data need be stored to give a coarse measurement of ambient pressure change. In response to supply from the central processor unit of given values of engine speed and thottle opening, this unit supplies the central processor unit with an expected value for manifold pressure.

The central processor unit also has an output leading to an air/fuel ratio sensor. This may be a sensor which measures the degree of leanness of the mixture by combusting an auxiliary fuel in the exhaust gases and measuring the heating effect of this combustion. The output from the central processor unit to the air/fuel ratio sensor simply initiates operation of the air/fuel ratio sensor. An indication of the air/fuel ratio sensed is supplied to the central processor unit. If appropriate, the central processor unit then provides a signal to an air/fuel ratio control to adjust the air/fuel ratio to a desired level.

The basic operations occurring within the central processor unit will now be described with reference to FIG. 2. On starting the vehicle engine, the coolant temperature is compared with ambient temperature and if coolant temperature is not more than t°C. above ambient temperature the process proceeds to point A at which point an air/fuel ratio measurement is initiated as will be described subsequently.

If coolant temperature is above ambient by more than t°C., the system goes into the altitude sensing mode. Throttle angle, engine speed and manifold pressure are measured and the calibrated manifold pressure for the measured engine speed and throttle opening is looked up. The ratio between measured manifold pressure and the stored calibrated value is derived as a percentage to give a measure of current ambient pressure. This percentage is compared with a previously recorded and stored value for this percentage ratio, representative of the ambient pressure at which the last calibration took place. There is a delay of approximately 200 seconds inherent in this comparison. If this change exceeds a given pressure difference $\Delta P$, the process again proceeds to point A. In the absence of a substantial pressure change, the initial monitoring process is repeated at approximately 200 second intervals until a substantial pressure change, indicative of a change in altitude, is measured.

Once point A is reached, the following checks are carried out successively:

(i) That coolant temperature is up to substantially normal running temperature and in particular is above $t_2$°C.

(ii) That the inlet manifold pressure is within a range indicative of operation of the vehicle in a normal cruising mode.

(iii) That the engine speed is within a range indicative of vehicle operation in a normal cruising mode.

(iv) That the throttle opening is within a range indicative of vehicle operation in a normal cruising mode.

(v) That the rate of change of throttle opening is below a predetermined level. Rather than measuring a rate of change as such, it is convenient to sense throttle opening at regular predetermined frequent intervals, to compare the current reading with an immediately preceding reading and assume a low rate of change when the difference between the two readings is less than a predetermined amount.

When the results of all five checks are affirmative, calibration is initiated. That is the air/fuel ratio sensor is brought into operation and if the measured ratio differs substantially from a desired stored value the air/fuel ratio control is operated to vary the air/fuel ratio.

If the result of one of the five checks (i) to (v) above is negative and no previous calibration has been effected since the vehicle was started, the operation reverts to point A and the process from there is repeated.

Immediately after calibration has been effected or if the various sensors indicate that the vehicle is not in its normal cruising mode and there has been a previous calibration, the control reverts to its starting point.

It can be seen that whenever the engine coolant temperature is low on starting the engine calibration will be carried out as soon as normal cruising conditions are reached. This will not be until the coolant temperature has reached a normal running level. If the coolant temperature is above the low level of t°C., (i.e. above the temperature which suggests the start of a new day) when the engine is switched on, a comparison of current and previous ambient pressures is carried out and a calibration then follows if but only if there has been a substantial change in ambient pressure since the last calibration. In this way, calibration is effected when it is likely to be needed but the number of calibrations is very much restricted with the result that the auxiliary fuel supply used during calibration has a long life.

We claim:

1. A control system for an air/fuel ratio measurement and adjustment system for an internal combustion engine, the control system comprising: an ambient temperature sensor, an engine coolant temperature sensor and means for initiating measurement of the air/fuel ratio in response to the engine coolant temperature not exceeding ambient temperature by more than a predetermined amount.

2. A control system as claimed in claim 1 wherein the control system comprises: means for measuring the extent of engine inlet throttle opening, engine speed and absolute inlet manifold pressure; means for deriving from stored information an expected inlet manifold pressure to correspond to the measured throttle opening and engine speed; means for deriving and storing the ratio between the expected and actual manifold pressures, means for comparing a subsequently derived ratio between the expected and actual manifold pressures with a previously determined such ratio and means for initiating measurement of the air/fuel ratio in response to a predetermined extent of change in said pressure ratio.

3. A control system as claimed in claim 1 wherein prior to initiating measurement of the air/fuel ratio a check is carried out to establish that the vehicle is operating in a normal cruising mode and measurement is initiated only during such a normal cruising mode.

4. A control system as claimed in claim 3 wherein the factors measured to establish operation in a normal cruising mode include engine speed, manifold pressure and degree of throttle opening.

5. A control system as claimed in claim 4 wherein the factors also include engine coolant temperature.

6. A control system as claimed in claim 4 wherein the factors also include rate of change of throttle opening.

* * * * *